United States Patent [19]

Kobayashi et al.

[11] 4,109,452

[45] Aug. 29, 1978

[54] SPINNING ROTOR UTILIZED FOR AN OPEN-END SPINNING APPARATUS

[75] Inventors: Akira Kobayashi, Obu; Kunji Chiba, Kariya; Noriaki Miyamoto, Kariya; Masao Shiraki, Kariya; Naotake Furukawa, Higashiuramachi, all of Japan

[73] Assignee: Kabushiki Kaisha Toyoda Jidoshokki Seisakusho, Japan

[21] Appl. No.: 787,026

[22] Filed: Apr. 13, 1977

[30] Foreign Application Priority Data

Apr. 17, 1976 [JP] Japan ..... 51-43921

[51] Int. Cl.[2] ..... D01H 1/12

[52] U.S. Cl. ..... 57/58.89

[58] Field of Search ..... 57/58.89–58.95

[56] References Cited

U.S. PATENT DOCUMENTS 3,796,034 3/1974 Grau ..... 57/58.89 X 3,908,349 9/1975 Urifer et al. ..... 57/58.89

FOREIGN PATENT DOCUMENTS 46-19738 6/1971 Japan ..... 57/58.89

*Primary Examiner*—Charles Gorenstein

*Attorney, Agent, or Firm*—Burgess, Ryan and Wayne

[57] ABSTRACT

In an open-end spinning apparatus provided with a fiber feed mechanism, a combing roller for separating a bundle of fibers supplied from the feed mechanism into individual fibers, a spinning rotor for receiving individual fibers delivered from the combing roller and for forming a ring shaped bundle of fibers on a fiber collecting zone formed at an inside wall position having a maximum lateral diameter with respect to a rotational axis thereof, and a yarn guide means for introducing a yarn formed in the spinning rotor toward a takeup mechanism disposed at a position outside the spinning rotor, a plurality of air streams are directly blown toward the fiber collecting zone by means of air stream creating means so that the ring shaped bundle of fibers deposited on the fiber collecting surface is urged toward the inside wall of the rotor at this collecting zone by the action of the air stream together with the centrifugal force of the fibers which is created by the rotation of the spinning rotor.

5 Claims, 4 Drawing Figures

SPINNING ROTOR UTILIZED FOR AN OPEN-END SPINNING APPARATUS

SUMMARY OF THE INVENTION

The present invention relates to a spinning rotor utilized for an open-end spinning apparatus.

It is well known that the open-end spinning apparatus is an extremely valuable yarn producing apparatus and has established an epochmaking spinning technology in recent years. It is reported that several types of open-end spinning apparatus based on a substantially identical principle are now practically utilized in many spinning factories in the world. However, it is well known that the yarn qualities, such as tensile strength, of the yarn produced by such open-end spinning apparatus are not good enough in comparison with the yarn produced by the conventional ring spinning apparatus. To solve this problem, such mechanical improvement of the open-end spinning device as the idea disclosed in the Japanese patent publication No. 18094(1975) was proposed for application to the practical apparatus. For the sake of better understanding this prior art, the principle upon which this technical idea relies is hereinafter explained.

As is well known, in the conventional open-end spinning device, when fibers are introduced into a spinning rotor, these fibers are deposited on a middle ring shaped portion, having the maximum diameter, due to a given centrifugal force applied to these fibers, which force is created by high speed rotation of the spinning rotor. Consequently, these supplied fibers are collected on the above-mentioned ring shaped portion (hereinafter referred to as a fiber collecting zone). Then, these fibers are taken from the fiber collecting zone while twists are imparted thereto. In the company where the inventor of the above-mentioned invention, disclosed in the Japanese patent publication No. 18094(1975), has been employed, it has been understood that, since the deposition of the supplied fibers at the fiber collecting zone only relies upon the centrifugal force applied to these fibers, which is created by the rotation of the spinning rotor, it is impossible to create a condition wherein the bundle of deposited fibers at the fiber collecting zone is formed in a compact condition.

Therefore, when the deposited fibers are taken from the fiber collecting zone so as to form a yarn, these fibers are separated from the fiber collecting zone in a condition against the centrifugal force applied thereto. Consequently, the tension applied to these fibers is not so strong that it is impossible to impart twists to these fibers taken from the fiber collecting zone, but there is sufficient tension, to strengthen freely slackened deposited fibers toward the taking-up direction thereof from the fiber collecting zone. If some fibers in slackened condition are involved in the fibers taken from the fiber collecting zone, since these fibers are possibly distributed in the yarn in zig-zag arrangement with respect to the lengthwise direction of the yarn, the proper yarn strength, which can be expected from the yarn composed of a fiber arrangement of the strengthened individual fibers, can not be realized.

The principle of the above-mentioned improvement is based on the understanding that the desirable increase of tension imparted to the fibers, when the fibers are taken from the fiber collecting zone of the spinning rotor, is attained by mechanically pressing the bundle of deposited fibers on the fiber collecting zone. In this prior art, a roller provided with a peripheral surface having a shape substantially the same as the wall of the fiber collecting zone of the spinning rotor, or a small ball, is disposed in the spinning rotor. When the spinning operation is carried out, the roller or the ball presses the band of the deposited fibers on the fiber collecting zone toward the wall of the spinning rotor and the roller or the ball displaces its radial pressing position with respect to the rotation axis of the spinning rotor while rotating itself in accordance with the taking off action of fibers from the fiber collecting zone of the spinning rotor.

However, according to repeated experimental tests, it was found that the above-mentioned invention can not be applied as a practical device. This is because of a problem that the above-mentioned motion of the roller or the ball creates serious vibration of the rotor axis, so that the durability of supporting bearing of the rotor axis is considerably reduced.

The purpose of the present invention is to provide a unique rotor for the open-end spinning apparatus which can be practically utilized in spinning factories and, more particularly, to provide a rotor for the open-end spinning apparatus wherein the deposited bundle of fibers on the fiber collecting zone of the rotor can be formed in desirable compact condition, without any undesirable troubles such as with the above-mentioned prior art, so that the quality of yarn can be effectively improved.

To attain the purpose of the present invention, the spinning rotor of the open-end spinning apparatus according to the present invention is provided with means for intentionally creating air streams directed toward the fiber collecting zone of the spinning rotor, so that a compact ring shaped bundle of deposited fibers can be formed on the fiber collecting zone, because of the additional force, which is created by the air stream, imparted thereto. Therefore, when the deposited fibers are taken from the fiber collecting zone, a pertinent tension is applied to these individual fibers so that these fibers are taken from the fiber collecting zone in strengthened condition. Accordingly, the quality of yarn produced by the open-end spinning apparatus can be improved very much.

DETAILED EXPLANATION OF THE INVENTION

For the sake of a better understanding of the present invention, the spinning rotor according to the present invention, which is utilized with the conventional open-end spinning apparatus, is explained. Therefore, the general construction and function of the elements of the open-end spinning apparatus are also explained together with the explanation of the spinning rotor according to the present invention.

Figure 1:
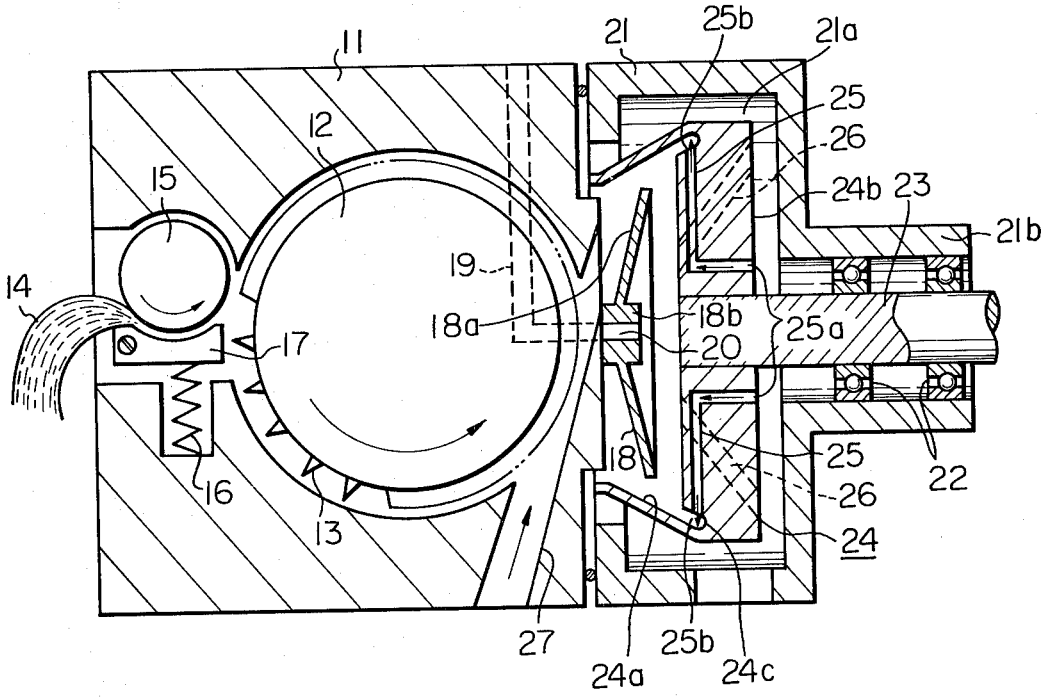
FIG. 1 is a schematic sectional view of a yarn forming mechanism of a conventional open-end spinning apparatus provided with an embodiment of a spinning rotor according to the present invention.
Figure 2:
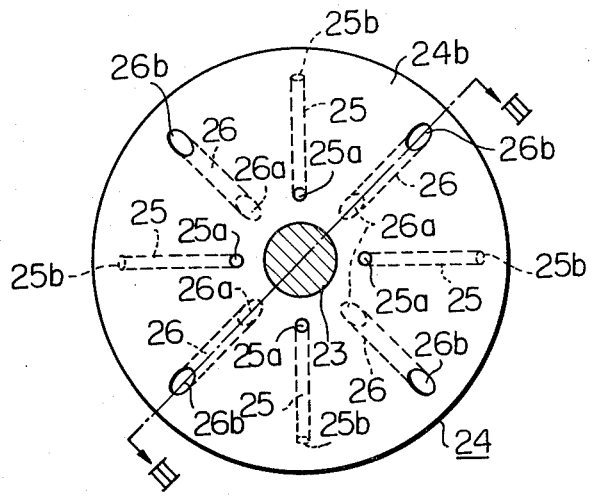
FIG. 2 is a schematic front view of the spinning rotor shown in FIG. 1.
Figure 3:
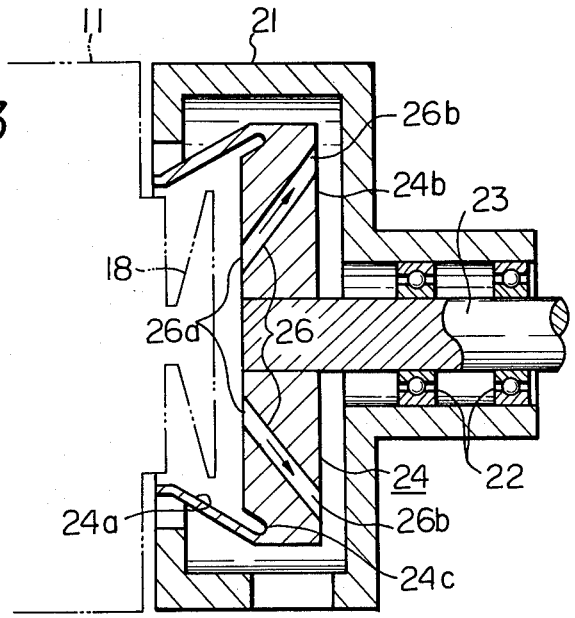
FIG. 3 is a schematic sectional view of a part of the yarn forming mechanism shown in FIG. 1, taken along a line and direction indicated by III—III in FIG. 2.

Referring to FIGS. 1, 2 and 3, in a spinning body 11, there is provided a combing roller 12 which is positively driving toward counter clockwise direction (in FIG. 1). The cylindrical surface combing roller 12 is covered with a combing wire 13 spirally mounted thereon so as to separate a bundle of fibers 14 supplied thereto. A feel roller 15, which is positively driven toward the same direction as the combing roller 12, is disposed in the spinning body 11 at a position upstream from the combing roller 12.

A presser 17 is disposed at a position adjacent to a part of a cylindrical surface of the feed roller 15 in such a condition that the presser 17 is always urged toward the feed roller 15 of means of a spring 16. Consequently, the bundle of fibers 14 is compressed by the gripping force created by the feed roller 15 and the presser 17, and is introduced to the combing roller 12. A separator 18, which comprises a funnel shaped portion 18*a* and a navel portion 18*b*, is rigidly mounted to a position of the spinning body 11 downstream from the combing roller 12.

A yarn guide aperture 20, which is connected to a yarn guide conduit 19 for introducing a created yarn to a takeup device (not shown), is coaxially formed in the navel portion 18*b*. A rotor case 21 is disposed to the same side of the spinning body 11 as the separator 18 in such a condition that a cylindrical chamber 21*a* of the case 21 is opened to the spinning body 11 and the separator 18 is positioned in the chamber 21*a*. A rotor shaft 23 is rotatably supported by a pair of bearings 22 disposed in a supporting part 21*b* of the rotor case 21 and a free end of the shaft 23 is projected into the cylindrical chamber 21*a* of the rotor case 21. The shaft 23 is positively driven by a driving mechanism (not shown).

A spinning rotor 24 according to the present invention is rigidly mounted on the free end portion of the shaft 23 so that the rotor 24 is capable of rotating in the cylindrical chamber 21*a*. The spinning rotor 24 is provided with a spinning chamber formed by a conical inside wall 24*a* and an inside flat wall of a main body 24*b* thereof. The lateral diameter of the inside wall 24*a* with respect to the rotational axis thereof is gradually expanded toward the direction of the supporting part 21*b* of the rotor case 21, and a ring shaped groove 24*c* is formed coaxial to the rotational axis of the rotor 24 at a position between the inside wall 24*a* and the flat wall of the main body 24*b*. This ring shaped groove 24*c* may be understood as a terminal of the inside wall 24*a* having the maximum inside diameter.

In the above-mentioned construction of the yarn forming mechanism of the open-end spinning apparatus, the separator 18 is positioned in the above-mentioned spinning chamber formed in the spinning rotor 24. The fibers introduced into the chamber of the spinning rotor 24 are deposited on the ring shaped groove 24*c*, which corresponds to the so-called fiber collecting zone of the spinning rotor of the conventional spinning rotor, since centrifugal force is imparted to the fibers due to the rotation of the spinning rotor 24. That is, when fibers are deposited on any part of the inside wall 24*a*, since the inside wall 24*a* is tapered as mentioned above, the deposited fibers are automatically displaced to the inside wall portion having larger diameter becuase of the action of the centrifugal force, and; finally, the fibers collected at the above-mentioned fiber collecting zone, so that a ring shaped bundle of fibers is formed on the ring shaped groove 24*c*.

The main body 24*b* of the rotor 24 is provided with a plurality of air supply conduits 25 arranged radially with respect to the rotational axis thereof as shown in FIG. 2. Each conduit 25 is provided with an inlet aperture 25*a* at a position adjacent to the rotational axis of the rotor 24, that is, a position adjacent to the shaft 23, and an outlet aperture 25*b* at a position facing the ring shaped groove 24*c*. In the embodiment shown in FIGS. 1 and 2, four air supply conduits are formed in the main body 24*b* of the rotor 24.

Since the distance between the rotational axis of the rotor 24 and the outlet aperture 25*b* is larger than the distance between the rotational axis of the rotor 24 and the inlet aperture 25*a*, an air stream from the inlet aperture 25*a* toward the outlet aperture 25*b* is created in each air supply conduit 25. This is because, when the spinning rotor 24 is rotated, the surface speed of the rotor 24 at the outlet aperture 25*b* is larger than the surface speed of the rotor at the inlet aperture 25*a*, so that an air flow is created toward the ring shaped groove 24*c*, that is, the fiber collecting zone of the spinning rotor 24.

In the open-end spinning apparatus utilizing a system of discharging air from the spinning chamber without utilizing any additional means for discharging air, that is, a system of maintaining the inside air pressure of the spinning chamber in a negative condition, a plurality of air discharge conduits 26 are formed in the spinning rotor 24 in such a condition that these discharge conduits 26 are radially distributed with respect to the rotational axis of the rotor 24. Each conduit 26 is provided with an inlet aperture 26*a* opened inside at a position adjacent to the free end of the shaft 23 and an outlet aperture 26*b* opend toward the inside wall of the case 21 at a position far from the shaft 23 (FIGS. 2 and 3). Therefore, when the spinning rotor 24 is rotated, an air stream from the inlet aperture 26*a* toward the outlet aperture 26*b* is created for the same reason as the creation of air stream in the conduit 25. Consequently, the air in the rotor 24 can be discharged from the inside of the spinning rotor 24 to outside thereof, that is, into the chamber 21*a* of the rotor case 21.

In a positive air discharge system, such as a system wherein the chamber 21*a* of the rotor case 21 is connected to a suction means, a modification is applied wherein the spinning chamber of the rotor 24 communicates with the chamber 21*a* of the rotor case 21. In this condition, the air conduits 26 are omitted while the air conduits 25 connected to outside of the rotor case 21, so as to introduce air from atmosphere, are utilized.

Consequently, air in the spinning rotor 24 is subjected to flow from the upper aperture of the rotor 24 to the chamber 21*a*, like the known positive system for discharging air.

In the embodiment shown in FIGS. 1 and 2, a fiber carrying passage 27 is formed in the spinning body 11 in such a condition that the fiber carrying passage 27 is tangentially directed to the peripheral cylindrical face of the combing wire 13 and the passage 27 is provided with an opening in the chamber of the spinning rotor 24 as shown in FIG. 1. Therefore, fibers are separated from the combing roller 12 by the stripping action of an air stream formed in the passage 27 and are carried into the chamber of the spinning rotor 24 together with the air from the passage 27.

In the above-mentioned open-end spinning apparatus, when the spinning operation is carried out, the bundle of fibers 14 is introduced into the combing roller 12 by means of the action of the feed roller 15 in combination with the presser 17, which also compress the bundle of fibers 14. The bundle of fibers 14 is separated into individual fibers by the combing action of the combing wire 13 of the rotating combing roller 12 and these separated fibers are carried to the position where the combing roller 12 meets the fiber passage 27.

Since the air stream passes through the fiber passage 27 at a speed higher than the peripheral speed of the combing wire 13, the carried fibers are separated from the combing wire 13 of the combing roller 12 and are carried into the chamber of the spinning rotor 24. The fibers thus carried into the chamber of the spinning rotor 24 are deposited on certain positions of the conical inside wall **24*a* of the spinning rotor 24, and then displaced to the ring shaped groove 24*c***, which is the fiber collecting zone, due to the action of the centrifugal force applied to these fibers.

As already explained, an air stream directed toward the fiber collecting zone is created in each air supply conduit 25 of the spinning rotor 24, while air separated from the deposited fibers, which is a combination of air introduced from the fiber carrying passage 27 and air indroduced from the conduits 25, is discharged from the chamber of the spinning rotor 24 to the chamber **21*a* of the rotor case 21 by way of the discharge air conduits 26. According to the centrifugal force applied to the fibers and the above-mentioned creation of air streams directed to the fiber collecting zone where a ring shaft bundle of fibers is continuously formed during the spinning operation, a bundle of the deposited fibers having compact configuration can be stably created. Consequently, very effective tension can be imparted to fibers taken from the fiber collecting zone of the spinning rotor 24** so that effective interference between those fibers is created.

Therefore, a desirable configuration of twisted yarn can be created, wherein individual fibers are uniformly intertivined with each other in a compact condition of a yarn which is created by twists. Accordingly the problems concerning the yarn quality which have needed to be improved in the open-end spinning technology can be solved by the application of the spinning rotor according to the present invention. Since the above-mentioned means for forming the deposited bundle of the fibers upon the fiber collecting zone in a compact condition, which does not need any additional movable members such as the roller or the ball disclosed in the above-mentioned prior art, is applied for the spinning rotor according to the present invention, the durability of the open-end spinning apparatus is not injured.

Figure 4:
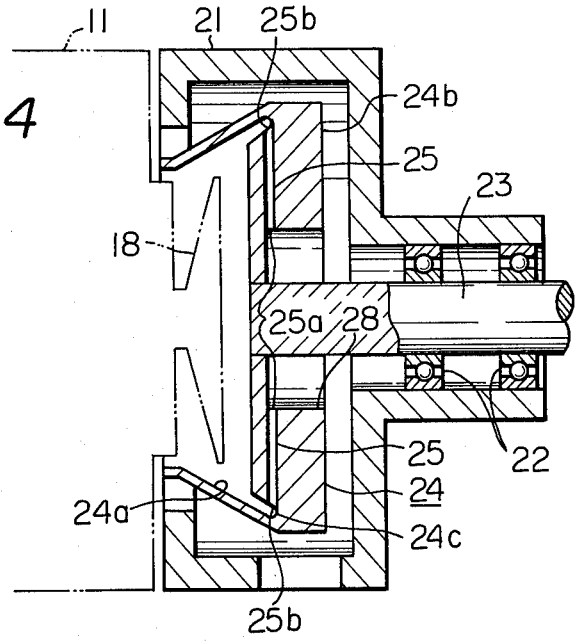
FIG. 4 is a schematic sectional view of a part of the yarn forming mechanism of a conventional open-end spinning apparatus provided with a modified embodiment of a spinning rotor according to the present invention.

The embodiment of the spinning rotor shown in FIG. 4 is a modification of the spinning rotor shown in FIGS. 1, 2 and 3. In this embodiment, a ring shaped recess 28 is formed in the main body **24*b* of the spinning rotor 24 at a position adjacent to the shaft 23 in a coaxial condition thereto. The inlet aperture 25*a* of each air supply conduit 25 is opened to the ring shaped recess 28**. It was confirmed that such a modification of the air supply conduit does not create any undesirable result for the purpose of the present invention.

In the above-mentioned embodiments of the present invention, the rotor 24 is provided with a ring shaped groove **24*c* having the largest lateral diameter in the chamber of the rotor 24. However, the principle of the present invention based upon the idea of creating air streams directed to the fiber collecting zone in the spinning rotor is not restricted only to the spinning rotor having such ring shaped groove as the above-mentioned embodiments, in other words, this principle of the present invention may be effectively applied to any type of spinning rotor provided with a fiber collecting surface. It should be further realized that, even though the air supply conduits 25 are formed in the main body 24*b* of the spinning rotor 24 so as to create the air streams directed to the fiber collecting zone of the spinning rotor 24** in the above-mentioned embodiments, any other means for creating such air stream directed to the fiber collecting zone of the spinning rotor beside those of the above-mentioned embodiments is within the spirit of the present invention.

What is claimed is:

1. In an open-end spinning apparatus provided with a fiber feed mechanism, means for separating a bundle of fibers supplied from the fiber feed mechanism into individual fibers, a rotatable spinning rotor for receiving individual fibers delivered from said separating means, means for taking up a yarn formed in said spinning rotor and a yarn guide means for introducing said yarn from said spinning rotor to said takeup means; the improvement wherein said spinning rotor comprises, in combination, a fiber collecting zone formed at an inside wall position having a maximum lateral diameter with respect to a rotational axis thereof, means for discharging air separated from said deposited fibers from inside the chamber of said spinning rotor to a position outside said rotor and means for continuously blowing a plurality of air streams directly toward said fiber collecting zone from a region peripheral to said rotational axis of said spinning rotor, while said rotor is operating.

2. In an open-end spinning apparatus provided with a fiber feed mechanism, means for separating a bundle of fibers supplied from the fiber feed mechanism into individual fibers, a rotatable spinning rotor for receiving individual fibers delivered from said separating means, means for taking up a yarn formed in said spinning rotor and a yarn guide means for introducing said yarn from said spinning rotor to said takeup means; a spinning rotor which comprises, in combination, a chamber provided with a discshaped lateral cross-section with respect to said rotational axis thereof and a main body portion, a fiber collecting zone formed at an inside wall position of said chamber having a maximum lateral diameter with respect to a rotational axis thereof, wherein said chamber is formed so that said fiber collecting zone is formed at a bottom peripheral wall of said chamber, and means for discharging air separated from said deposited fibers from inside the chamber of said spinning rotor to a position outside said rotor and means for blowing a plurality of air streams directly toward said fiber collecting zone from a region peripheral to said rotational axis of said spinning rotor, said blowing means comprising a plurality of air stream forming conduits radially formed in said main body portion with respect to said rotational axis of said rotor, each of said conduits being provided with an inlet aperture opened outside of said main body at a first position and with an outlet aperture opened toward said fiber collecting zone at a second position, the distance between said first position and said axial center of said rotor being shorter than the distance between said second position and said axial center of said rotor.

3. A spinning rotor according to claim 2, wherein said chamber of said rotor is a conical shaped chamber, said lateral cross-section is gradually expanded toward a direction of said main body, a ring shaped groove is formed at a said bottom position of said peripheral inside wall of said chamber so that said ring shaped groove functions as said fiber collecting zone.

4. A spinning rotor according to claim 2, wherein said first position is selected at a position adjacent to said axial center of said rotor while said second position is selected at a position adjacent to said fiber collecting zone.

5. A spinning rotor according to claim 2, wherein said spinning rotor is provided with a ring shaped recess formed at a radial position adjacent to said rotational axis of said rotor in coaxial relation thereto, said radial position is selected outside of said rotor and said inlet aperture of each air stream forming conduit is opened to said ring shaped recess.

* * * * *

UNITED STATES PATENT OFFICE

CERTIFICATE OF CORRECTION

Patent No. 4,109,452 Dated August 29, 1978

Inventor(s) Akira Kobayashi, et al

It is certified that error appears in the above-identified patent and that said Letters Patent are hereby corrected as shown below:

Column 5, line 27: "indroduced" should be --introduced-- line 42: "intertivined" should be-- intertwined--

Column 6, line 45: "discshaped" should be --disc-shaped--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*